United States Patent [19]

Latsch et al.

[11] 4,099,493

[45] Jul. 11, 1978

[54] METHOD AND APPARATUS FOR CONTROLLING AN INTERNAL COMBUSTION ENGINE

[75] Inventors: Reinhard Latsch, Vaihingen; Valerio Bianchi, Hochdorf, both of Fed. Rep. of Germany

[73] Assignee: Robert Bosch GmbH, Stuttgart, Fed. Rep. of Germany

[21] Appl. No.: 664,396

[22] Filed: Mar. 5, 1976

Related U.S. Application Data

[63] Continuation-in-part of Ser. No. 597,404, Jul. 18, 1975, abandoned.

[30] Foreign Application Priority Data

Mar. 5, 1975 [DE] Fed. Rep. of Germany ..... 2509505

[51] Int. Cl.[2] ..... F02B 3/00

[52] U.S. Cl. ..... 123/32 EA; 123/32 EH

[58] Field of Search ..... 73/117.3, 517 A, 70.1; 123/32 EA, 32 EH

[56] References Cited

U.S. PATENT DOCUMENTS

| | | | |
|---|---|---|---|
| 2,655,036 | 10/1953 | Chapman | 73/517 A |
| 3,789,816 | 2/1974 | Taplin | 123/32 EA |

*Primary Examiner*—Ronald B. Cox

*Attorney, Agent, or Firm*—Edwin E. Greigg

[57] ABSTRACT

An internal combustion engine is operated in the lean-running condition where measurable engine roughness occurs. The degree of this engine roughness, which is due to fluctuations in acceleration, is measured and compared with set-point values in a fuel metering control loop. In order to prevent undesirable control characteristics, the effect of positive changes in acceleration is prevented from engaging the final control element by a switching element which interrupts the signal flow to the final control element during positive changes in engine accelerations.

3 Claims, 1 Drawing Figure

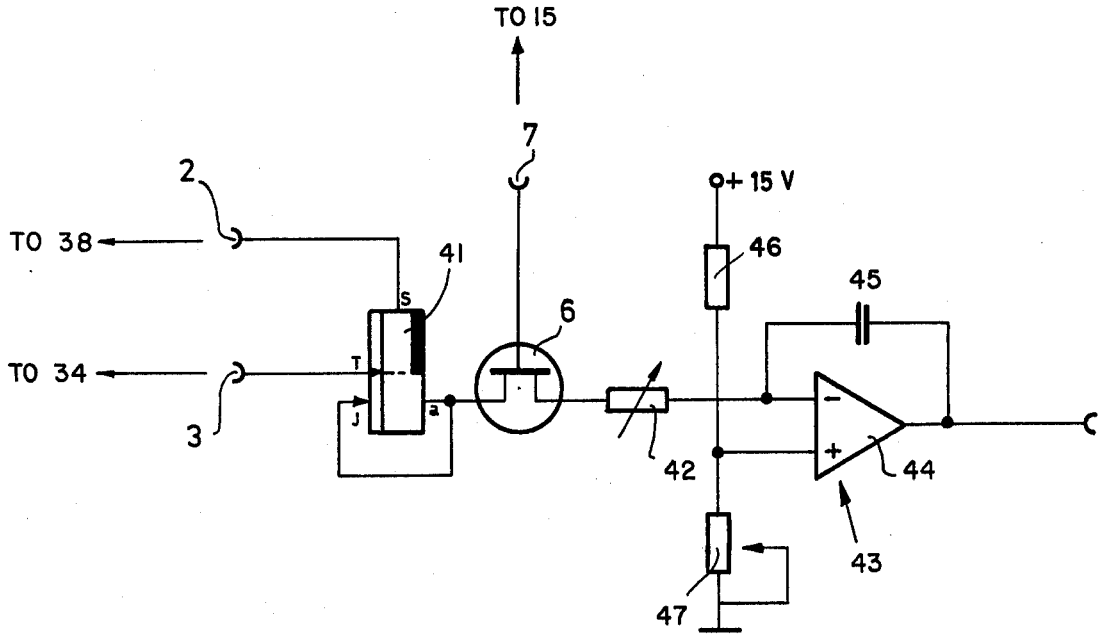
TO 15
7
2
+ 15 V
TO 38
41
46
45
S
6
T
TO 34
J
a
3
42
44
43
47

METHOD AND APPARATUS FOR CONTROLLING AN INTERNAL COMBUSTION ENGINE

The present application is a continuation-in-part application of Patent Application Ser. No. 597,404 filed July 18, 1975, now abandoned, and relates to improvements of the method and the apparatus described therein for obtaining a more stable control behavior.

BACKGROUND OF THE INVENTION

The disclosure relates to a method and an apparatus for controlling the operational performance of an internal combustion engine within a predetermined domain. The method and the apparatus relate to changes in the fuel-air ratio provided to the engine or the amount of recycled exhaust gas in dependence on dispersion of the cyclic variations of the mean combustion chamber pressure during intervals which are synchronous with the engine r.p.m. (dynamic stability control). The invention relates to providing a signal related to the non-uniform operation of the engine and a corresponding electrical signal related to a uniform engine operation and it further relates to determining the phase relations of these two signals as a measure for the control variable. The actual value is compared with the set-point value and a comparison signal is fed to an integrating final control element as described in detail in the parent application Ser. No. 597,404. It is the purpose of the control system described in the parent application Ser. No. 597,404 to permit operating internal combustion engines in a domain of operation in which toxic components of the exhaust gases are as low as possible and/or the fuel consumption is as low as possible so as to meet the evermore rigorous regulations regarding exhaust gas constituents and also to accomodate to the universal fuel shortage.

Thus, the parent application proposes a system that makes it possible to operate an internal combustion engine with a relatively lean fuel-air mixture, i.e., the engine is operated at a setting in the direction of a leaned-out mixture so that it can operate in a region which produces relatively harmless exhaust gas and low fuel consumption. For this purpose, it is very important to determine the desired operational point defining the lean running limit of the engine as exactly as possible and to operate the control system at that point. Since the dynamic instability of an internal combustion engine increases when the operation takes place further away from the stoichiometric ratio (air number $\lambda \approx 1$), the system of the parent application provides measuring the fluctuations in the mean cylinder pressure by going back to the torque fluctuations which are caused by pressure fluctuations in the cylinders. These torque fluctuations are measured with an r.p.m. synchronous signal derived from crankshaft rotation corresponding to the changes in angular acceleration and this signal is used to generate a control signal.

For this purpose, the apparatus of the parent application provides a crankshaft marker and an inductive transducer which generates a signal when the marker passes it, and this signal is fed to a pulse shaping stage and hence to a phase comparator circuit. At the same time, the signal is integrated twice and fed to a voltage controlled oscillator whose output signal is fed to the second input of the phase comparator. This hook-up is a so-called PLL loop (Phase locked loop).

It is the purpose of such a circuit to measure the period of time elapsing between the passage of crankshaft markers and thus to create an electronically simulated comparison system which runs at the same basic r.p.m. of the engine crankshaft but does not have the cyclic variations whose measurement finally results in obtaining the control signal. In other words, one of the two inputs of the comparison circuit receives a signal which corresponds to a uniformly rotating engine, whereas the other input receives a signal whose value is related to the either positive or negative engine accelerations and which comes from the preceding pulse shaping stage.

At the output of the second integrating circuit, the signal, which now corresponds to the crankshaft r.p.m., is transformed into a proportional current and serves to charge a capacitor, and the charging process is controlled by the output signal from the phase comparator which corresponds to changes in the crankshaft period of revolution. Thus, the capacitor is charged in proportion to the error in the period of rotation multiplied by the r.p.m., and the voltage on the capacitor is proportional to these values. In particular, the circuit used in the apparatus of the parent application is shown in FIG. 3 thereof. The signal from the capacitor which was charged in proportion to r.p.m. is fed to the non-inverting input of an operational amplifier, connected as a comparator, whose other input receives a nominal, or set-point, value. The output of the comparing operational amplifier is fed to a bistable multivibrator whose output signal is either a logical 1 or a logical 0. If the output of the bistable multivibrator is a 0, then a subsequent integrating final control element, in the form of an operational amplifier, integrates in the positive direction, i.e., the output voltage of the operational amplifier increases. On the other hand, if the output of the bistable multivibrator is a logical 1, then the actual value is greater than the set-point value and the output signal from the operational amplifier (final control element) goes to 0. The bistable multivibrator is set by a clock pulse which ultimately comes from the output of the phase comparator circuit (more precisely from a subsequent amplifier).

In the known circuit, it is possible that conditions may arise which will cause the control process to become unsatisfactory. Such conditions are, for example, when the engine is operated at an extremely lean operational point and when the supplied fuel quantity is changed in the direction of enrichment ($\lambda$-correction) so that the torque of the engine increases and thus indicates a positive acceleration. This positive acceleration is not, in principle, a dynamic instability but rather is a desired change, but the controller senses it as a dynamic instability and thus causes the final control element to perform a further $\lambda$-correction in the direction of an enriched mixture. This behavior can cause instability or control oscillations.

OBJECT AND SUMMARY OF THE INVENTION

Accordingly, it is an object of the present invention to improve the method of control and the apparatus described in the parent application to obtain a more stable control behavior while the engine is operated in a very lean condition. This purpose is achieved by the present invention by an improvement of the control system described in the parent application which provides interrupting the supply of the comparison signal to the final control element whenever the engine undergoes positive acceleration, thereby eliminating systematic errors and maintaining the actual degree of mixture leaning in the fuel-air mixture.

Since the improved control method reacts only to negative engine acceleration changes, i.e., the influence of positive changes in acceleration, which are due to a deliberate and desired enrichment of the supplied fuel-air mixture, are ignored. Thus, the mixture is enriched only to the degree that corresponds to a stable operational point within the desired lean domain of operation. Hence, the control behavior is free of oscillations and the desired operational point may be found at any time without having to traverse a region of unstable control behavior.

The invention will be better understood and further objects and advantages will become more apparent from the ensuing detailed specification of a preferred embodiment taken in conjunction with the single FIGURE of the drawing.

BRIEF DESCRIPTION OF THE DRAWING

The single FIGURE of the drawing is a schematic diagram of the improvement in the control circuit according to the invention, to be used in the controller defined in the parent application.

DESCRIPTION OF THE PREFERRED EMBODIMENT

Turning now to the single FIGURE, there is shown a bistable multivibrator 41 controlled by the comparator mentioned above and further described in the parent application. This comparator, which has the reference numeral 38 in the parent application, exerts its control via the input contact 2, in the present FIGURE, which is connected to the set input of the bistable multivibrator 1 which is therefore brought into a position in which its output is a logical 1. Via the contact 3, the bistable multivibrator 1 receives a clock signal which returns the multivibrator to its preferred position in which it has a 0 output signal. The clock signal is generated in a switching transistor, which has the reference numeral 34 in the parent application, whose input is connected to the output of the phase comparator circuit. The operation which takes place is the following. The comparator circuit generates short output pulses whenever the comparison between the actual and set-point values shows that the actual value is greater than the set-point value. In that case, the output of the bistable multivibrator is a logical 1 and the integrating final control element 43, which is connected to the output of the bistable multivibrator via an adjustable resistor 42, and which acts as an operational amplifier 5, adjusts its output signal toward 0. An integrating capacitor 45 is connected between the output and the inverting input of the operational amplifier 44. A reference voltage, taken from the top of a voltage divider consisting of resistors 46 and 47 is fed to the non-inverting input of the operational amplifier 44.

The output signal from the operational amplifier 44 may, for example, engage the control link of an electronic fuel control system and thus the composition of the fuel-air mixture may be changed by lengthening or shortening the fuel injection pulses. If, on the other hand, the actual value is smaller than the set-point value, then the set input of the bistable multivibrator 41 receives no pulses and the logical 0 received by the integrating final control element is integrated in the positive direction.

In the circuit so far described, the signal related to the dynamic instability, which is defined by the expression $\Delta(\Delta T)/T^3$ and which includes positive as well as negative changes in the angular acceleration, is treated in the same way. Thus, both during negative as well as positive changes in the angular acceleration, a λ-correction takes place in the direction of a richer mixture when the engine operates in the region of extremely lean operational points. However, this adjustment causes an increase of the torque and thus a positive change in the acceleration, although this positive change is not to be regarded as dynamic instability but rather constitutes a desired change in the actual value to the set-point value, but the previously proposed control circuit still regards this change as a signal constituting dynamic instability (engine roughness).

Thus, it is a characteristic of the present invention to effect no correction of the supplied fuel quantity during positive changes in the acceleration. Rather, the previously present degree of leaning, or the previous operational point of the engine is maintained, for example by disconnecting the signal from the inverting input of the integrating final control element. In this manner, when there are strong positive changes in the acceleration, the slope in the integrator is reduced to zero.

In the circuit shown, when positive accelerations occur, an interrupter switch 6, which is connected in the input circuit to the integrating final control element 43, opens whenever the apparatus recognizes positive changes in acceleration. For this purpose, the interrupter 6 is controlled by a signal which could be derived directly from the second output of the phase comparator circuit which has the reference numeral 15 in the parent application and which is so chosen that it opens the interrupter 6 during positive changes in acceleration. In the preferred exemplary embodiment shown, this interrupter switch is a field effect transistor connected in series with the integrating final control element 43 so as to block the conduction during positive changes in acceleration.

Thus, when the engine operates in an extremely lean domain, a more stable control behavior is obtained while maintaining an rpm-dependent slope of integration because the system continues to operate during negative changes in acceleration.

The above description relates to a method and apparatus of a preferred embodiment of the invention and many alternative embodiments and variants are possible within the scope of the invention which is defined by the appended claims.

What is claimed is:

1. A method for controlling the operation of an internal combustion engine, comprising the steps of:

(A) determining the scattering of the cyclic fluctuations of the average combustion chamber pressure during time intervals which are synchronous with the engine r.p.m. and generating a first signal representative thereof;

(B) generating a second signal representative of engine r.p.m. but not including dependence on said fluctuations;

(C) performing a phase comparison of said first and second signals and generating a comparison signal representative of this phase comparison;

(D) feeding said comparison signal to a final control element for adjusting the fuel-air ratio of the fuel-air mixture admitted to the internal combustion engine; and (E) interrupting the feeding of said comparison signal to said final control element whenever said phase comparison indicates changes in engine acceleration toward increasing values of acceleration, but maintaining the feeding of said comparison signal to said final control element whenever said phase comparison indicates changes in engine acceleration toward decreasing values of acceleration; whereby the fuel-air mixture remains unchanged during positive changes in engine acceleration.

2. An apparatus for controlling the operation of an internal combustion engine, which engine includes rotating drive means and fuel control means comprising;

(A) sensor means, associated with said rotating drive means, for forming an electrical output related to the rotation of said rotating drive means;

(B) actual value signal generator means, connected to said sensor means, for generating an electrical actual value signal related to the actual rotation of said rotating drive means;

(C) nominal value signal generator means for generating an electrical nominal value signal dependent on the r.p.m. of said rotating drive means:

(D) comparator means, for performing a phase comparison between said actual value signal and said nominal value signal, and for generating an output signal;

(E) integrating final control means connected to receive said output signal for controlling said fuel control means, and (F) electrical switch means, disposed between said comparator means and said integrating final control means for interrupting the passage of said output signal during positive changes in acceleration of said rotating drive means, but maintaining the passage of said output signal during negative changes in acceleration of said rotating drive means.

3. An apparatus as defined in claim 2, wherein said electrical switch means is a field effect transistor whose control electrode is connected to said comparator means to receive signals related to positive and negative changes in acceleration of said rotating drive means.

* * * * *